US006315838B1

(12) United States Patent
Dunand et al.

(10) Patent No.: US 6,315,838 B1
(45) Date of Patent: Nov. 13, 2001

(54) DENSIFICATION VIA THERMAL TREATMENT

(75) Inventors: David C. Dunand; Christopher Schuh, both of Evanston, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 09/525,614

(22) Filed: Mar. 14, 2000

(51) Int. Cl.[7] ..... C21D 1/00; C22F 1/00
(52) U.S. Cl. ..... 148/95; 148/514; 419/29
(58) Field of Search ..... 148/95, 514; 419/29

(56) References Cited

U.S. PATENT DOCUMENTS 3,948,688 * 4/1976 Clark .
4,302,256 * 11/1981 Kenton .
4,981,528 * 1/1991 Fritzemeier et al. .
5,340,419 * 8/1994 Chandley ..... 148/631
5,573,609 * 11/1996 Fritzemeier et al. ..... 148/262
5,634,992 * 6/1997 Kelly et al. ..... 148/669

* cited by examiner

*Primary Examiner*—Ngoclan Mai
(74) *Attorney, Agent, or Firm*—Reinhart, Boerner, Van Deuren, Norris & Rieselbach, s.c.

(57) ABSTRACT

A method for creep cavity shrinkage and/or porosity reduction without applied stress. The thermal treatment is found to increase the rate of densification relative to isothermal annealing, allowing for more rapid recovery of desired theoretical density in a shorter time.

20 Claims, 6 Drawing Sheets

DENSIFICATION VIA THERMAL TREATMENT

CONTRACTUAL ORIGIN OF INVENTION

The United States Government has certain rights to this invention pursuant to Grant No. DAAH004-95-1-0629 from the United States Army of Research Office to Northwestern University.

BACKGROUND OF INVENTION

This invention relates generally to thermal treatment of various compositions, materials and/or material systems and, more particularly, to such treatment without external stresses and without phase transformation.

Thermal treatments, both with or without imposed external stresses, are commonly used to densify materials which contain internal pores or cavities. For instance, despite their outstanding creep resistance, oxide-dispersion-strengthened aluminum materials have limited creep ductility due to the formation and subsequent growth and linkage of creep cavities in service.

One approach to extending the creep-life of various engineering components is ex-situ treatments to close creep cavities after some service time. The technical literature contains many examples of the shrinkage and closure of cavities formed during service by isothermal heat treatment with or without superimposed hydrostatic pressure. Although isothermal heat treatment at ambient pressure is simple and inexpensive, the time required to fully close creep cavities is often prohibitive. Hot isostatic pressing (HIP) can more rapidly close porosity, but at an increased cost. Further, studies show that cavity shrinkage is strongly affected by the internal residual stress state, potentially increasing the rate of densification or causing cavity growth rather than shrinkage.

The technical literature provides another approach: densification of polymorphic metal powders by a process of thermal cycling while simultaneously applying an external stress. The related deformation mechanism for densification is referred to as transformation superplasticity, and results in a solid/solid phase transformation upon application of the external stress.

SUMMARY OF THE INVENTION

As apparent from the above, there are a considerable number of limitations in the prior art associated with metal densification. There is a demonstrated need for a general methodology to densify a variety of material systems efficiently, at low relative cost, and without application of external stresses.

Accordingly, it is an object of the present invention to provide a general methodology which can be used with a variety of material systems to reduce internal porosity, thereby overcoming various deficiencies, problems and shortcomings of the prior art, including those outlined above. It will be understood by those skilled in the art that one or more aspects of this invention can meet certain objectives, while one or more other aspects can meet certain other objectives. Each objective may not apply equally, in all instances, to every aspect of the present invention. As such, the following objects can be viewed in the alternative with respect to any one aspect of the present invention.

It can also be an object of present invention to provide a method of treating a material system to increase the relative density of the material at a more rapid rate than can be achieved by isothermal treatment at comparable temperatures.

It can also be an object of the present invention to densify materials cavitated under creep conditions and/or other service conditions.

It can also be an object of the present invention to enhance densification and/or the rate thereof as compared to other treatment methods of the prior art.

It can also be an object of the present invention to provide a general methodology for densification of a wide range of diverse material systems, with the parameters thereof as could be predicted by those skilled in the art with an understanding of the operative densification mechanisms.

Other objects, features, benefits and advantages of the present invention will be apparent in this summary, and the following descriptions and examples, and will be readily apparent to those skilled in the art having knowledge of various densification methods and/or the use of such work material systems of the type described herein. Such objects, features, benefits and advantages will be apparent from the above as taken in conjunction with the accompanying examples, tables, data, and mathematical and physical relationships, and all reasonable inferences to be drawn therefrom.

In part, the present invention includes a method of reducing internal material porosity, with reduction substantially without phase transformation. The inventive method includes: (1) providing an internally porous material; and (2) annealing the material over a temperature range providing activation energy sufficient to induce mass transport within the material, with the temperature changing during annealing. In this manner, the material porosity can be reduced substantially without phase transformation.

In various preferred embodiments of the present invention, the porous material is a polycrystalline single-phase material with anisotropic thermal expansion properties. In various other embodiments, the material is multi-phased, such that the material can include metallic phases, ceramic phases and/or combinations thereof which have different thermal expansion coefficients. In highly preferred embodiments of the present invention, the multi-phase material is a metal and metal oxide composite. A mismatch in thermal expansion can induce internal stress, to enhance densification.

Regardless, preferred embodiments of the present invention can include non-cyclic temperature change, over a range of temperatures, while the porous material is annealed. Alternatively, with equal effect depending on a particular material system, the temperature can change in a cyclic manner, over an indicated range. Whether with cyclic non-cyclic temperature change, the annealing process can be repeated for a time sufficient to density the particular material system. Internal pores and/or cavities can be reduced to the extent desired. In contrast to the prior art, desired densities can be achieved in a more cost efficient and more timely manner.

In part, the present invention is also a method of shrinking cavities introduced to a material system over time under service conditions such as creep. Whether the material is a single- or multi-phased composition, annealing is conducted within a given temperature range dependent upon the material system. The range includes temperatures which induce internal stress between phases of the compositions. Modifying such temperatures during annealing regenerates internal stresses of the type described herein necessary to induce mass transport. Such a method can be used to treat or rejuvenate materials previously stressed under creep conditions or otherwise damaged by adverse environmental factors.

In part, the present invention is also a method of using thermal treatment of the type described herein to enhance the rate of densification of a porous material. The method includes: (1) providing an internally porous material; (2) annealing the material over a temperature range, with the range of temperature inducing stresses internal to the material, and the temperature changing during annealing; and (3) densifying the material, substantially without application of external stress. As described more fully above, such a method can be used to treat a wide variety of material systems. Likewise, annealing can include either cyclic or non-cyclic temperature changes to effect the desired result.

In part, the present invention is also a method of assessing densification and related parameters for a variety of materials and/or material systems. The guidance and direction provided herein would allow one skilled in the art—through straightforward application of the principles, models, concepts and mathematical and physical relationships set forth herein—to determine such parameters and assess the resulting densification of a material/material system. One skilled in the art would expect variations in temperature range, cycle time, rate of temperature change, etc. depending upon a given material or system. Determination of such parameters, however, would be no more involved than efforts otherwise expended by those engaged in such endeavors. Any further experimentation would be no more than that ordinarily conducted by individuals skilled in the art, with the results predicted according to the present invention.

Likewise, the present invention can also be used to predict densification enhancements for a variety of compositions, materials and/or material systems, including those described herein. Such rates can be attributed to thermal-expansion-mismatch stresses, consistent with the present models and mathematical relationships and as experimentally observed. As such, one skilled in the art, using such models and relationships—together with the guidance and direction provided herein—would be able to predict both enhancements in rate and absolute values of densification, as compared to the methods and procedures of the prior art.

As discussed more thoroughly above, the present invention does not require use of external stresses to densify a given material system. However, as would be understood by those skilled in the art, the present invention allows for the use of external stresses in combination with the present methods, as might be required by a particular material system to provide the desired degree of densification.

The present methods of densification are particularly applicable to dispersion-strengthened metals; however the invention may also be generally applicable to many other materials containing porosity. For example, if a material contains two or more phases with different thermal expansion characteristics, then upon a thermal excursion internal mismatch stresses can be generated. Upon repeated thermal cycling, such internal stresses can be continuously renewed. During a sintering process whereby cavities are removed from such a material, thermal cycling and the attendant internal stresses produced by cycling accelerate densification in a manner similar to the application of an external stress. Accordingly and without limitation, the invention can be applicable to any material composed of two or more phases, i.e., containing (i) a metal and a ceramic phase (e.g., $Al/Al_2O_3$ composites such as discussed below), (ii) two metal phases (e.g., two-phase alloys such as Ti-6Al-4V with widespread commercial uses), (iii) two ceramic phases (e.g., $ZrO_2/Al_2O_3$ composites), or (iv) any combination of two or more metal and ceramic phases in any geometry, such as discontinuous reinforcement, continuous fiber reinforcement., laminates, etc. Furthermore, internal stress generation by thermal cycling is also possible in single-phase polycrystalline materials which exhibit anisotropy in their thermal expansion coefficients (e.g., zinc, uranium, many ceramics, etc.).

The present invention is especially suited for the closure of small amounts of porosity in dispersion-strengthened aluminum and other such materials. The invention is also applicable to any industry involved in the manufacture, use or treatment of materials containing porosity, such applications including but not limited to those listed below:

(1) Materials which are used in elevated-temperature applications often develop cavities which lower the component density and compromise its structural integrity. In particular, high-temperature nickel-base turbine blades, metal processing equipment, and components formed at elevated temperature (e.g. by forging or superplastic forming) may develop porosity.

(2) During industrial processes of powder consolidation to manufacture components, the remaining porosity in the final stages of densification typically takes the form of small, isolated cavities. Strength and ductility typically increase with increasing density. Example materials include but are not limited to tool steel and zirconia.

(3) Exposing crystalline materials to radiation such as that produced in nuclear reactors results in the formation of small cavities, decreasing their strength and ductility. Examples include, among others, stainless steel containment walls in reactors and zirconium fuel cladding.

(4) The presence of electrical current can cause migration of atoms in circuit elements, resulting in the formation of small cavities and eventual failure of the element. Examples include aluminum or copper electrical lines in microelectronic circuits.

The present invention demonstrates that by thermally treating and/or cycling materials under isobaric conditions, pores and creep cavities can be eliminated more rapidly than by isothermal annealing. Without restriction to any one theory or mode of operation, ,the enhanced densification and/or rates observed can be explained with consideration to thermal-expansion-mismatch stresses. The effect of intermittent thermal-cycling treatments on the isothermal creep-rupture behavior of dispersion-strengthened material systems can also be explained, as discussed herein.

BRIEF DESCRIPTION OF THE DRAWINGS

FIG. 2*a*, a single cavity at the matrix-dispersoid interface;

FIGS. 2*b* and 2*c*, additional cavity illustrations.

EXAMPLES OF THE INVENTION

The following non-limiting examples and data illustrate various aspects and features relating to the methods and applications of this invention, including the surprising and unexpected results associated with densification under the conditions described herein. Comparable results, advantages and utility can be realized using various other material systems, consistent with this invention, as with the well known to those skilled in the art familiar with this invention, the mathematical and physical relationships described herein, and the requisite knowledge to apply by analogy those relationships and principles to the materials, compositions and/or material systems described or inferred elsewhere herein.

Example 1

The material chosen to illustrate the broad methodologies described herein was as-cast dispersion-strengthened-cast aluminum (DSC-Al) with about 23% alumina dispersoids, from Chesapeake Composites Corp. (Newcastle, Del.). Microstructural characteristics as well as ambient and elevated temperature mechanical properties of this material can be found in the literature. The dispersoid particles are approximately spherical with an average diameter of about 0.3 μm and are well-dispersed in large matrix grains (~2–10 mm diameter).

Cavity Shrinkage Experiments

Example 2

The specimens tested in these experiments were previously crept to failure at various temperatures and uniaxial tensile stresses in a separate study summarized in Table I, below. The gauge pieces were separated from the heads with a diamond blade, and the material in the vicinity of the fracture surface (where cavitation may be more extensive) was also removed. The resulting cylindrical specimens were approximately 20–30 mm long, with diameters of about 4.7 mm. The volume, fraction of reinforcement, f, as reported in Table I was determined by density measurement prior to creep, neglecting the small amount of casting porosity known to exist in these materials.

TABLE I

Summary of specimens used in present study, including prior creep history as found in literature and determined from and current experimental conditions

| | | | | Prior Creep History | | | Experiment in Present Work | |
|---|---|---|---|---|---|---|---|---|
| Specimen | Mass [g] | f | T[° C.] | σ[MPa] | ϵ[%] | ρ | Thermal Treatment | Measurement |
| A1 | 1.154 | 0.232 | 400 | 69 | 4.8 | 0.982 | 351° C., 1120 min. | Density |
| A2 | 1.167 | | | | | 0.981 | 200–400° C., 1120 min. | Density |
| B1 | 1.062 | 0.215 | 400 | 81.5 | 6.8 | 0.981 | 400° C., 1520 min. | Density |
| B2 | 1.068 | | | | | 0.979 | 200–400° C., 1520 min. | Density |
| C | 1.825 | 0.223 | 400 | 56.2 | 4.3 | 0.978 | 200–400° C., 1200 min. | Density |
| D | 3.157 | 0.237 | 370 | 56.2 | 2.8 | 0.987 | 200–400°, 2400 min. | Density & Length |
| E | — | 0.234 | 450 | 56.2 | 4.2 | 0.983 | TEM | — |

Example 3

Figure 1:
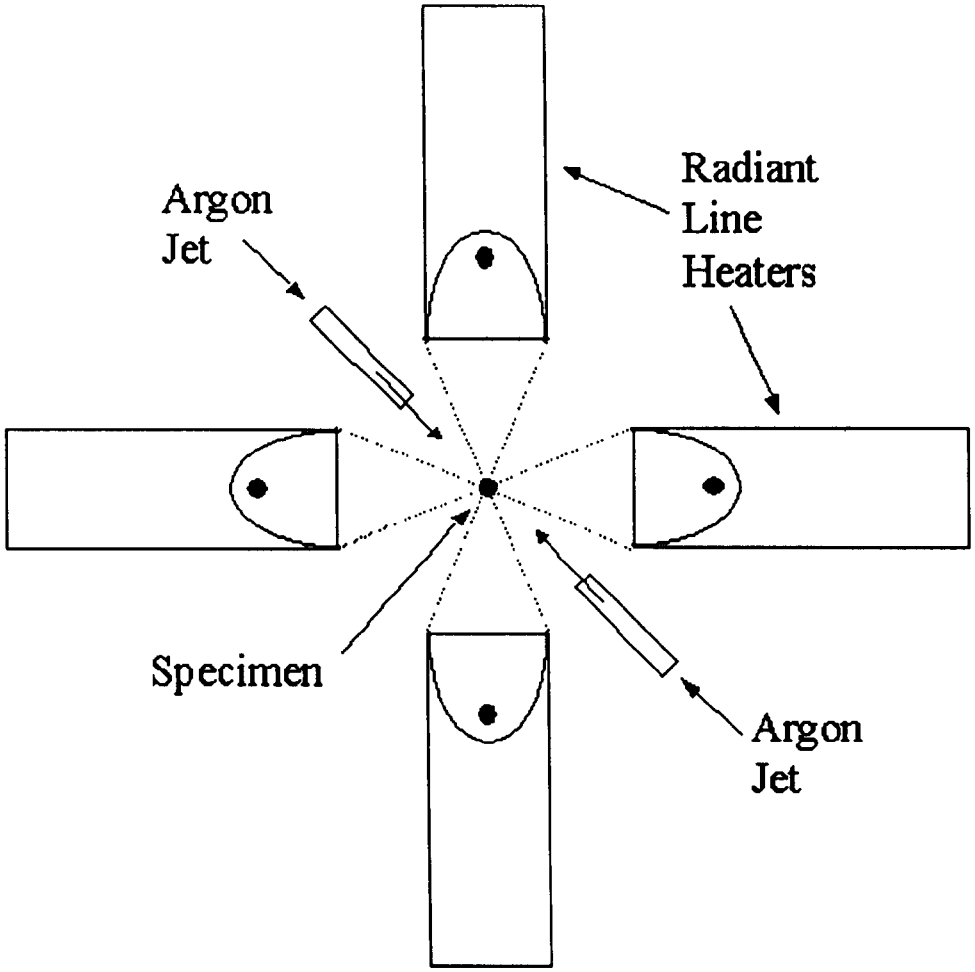
FIG. 1 is a schematic representation of an apparatus of the type which can be used in isothermal and thermal-cycling heat treatments, as would be recognized by those skilled in the art.

The cavitated specimens were given various thermal treatments to assess the kinetics of creep-cavity shrinkage. These treatments were performed in a radiant furnace consisting of four symmetrically-positioned line heaters, outfitted with two jets of argon gas, as shown in FIG. 1. The combination of radiant heating and forced-convection cooling allowed for rapid thermal excursions. For purposes of thermal control, a small radial hole was drilled into the side of each specimen to a depth of about half the specimen diameter, into which a small-bead, rapid-response, type-K thermocouple was inserted. The hole and thermocouple bead were then covered with zirconia thermal insulation to minimize the effect of either radiative or convective heat flux from the heaters or argon jets, respectively. This procedure ensured that the recorded temperature was an accurate measurement of the specimen temperature. Closed-loop thermal control maintained the prescribed temperature to within ±2 K for most of the duration of each experiment, with maximum deviations of less than 10 K during rapid heating or cooling at the beginning and end of each stage of thermal treatment. On some specimens a second thermocouple was attached in the same manner as the first, but at a different position along the gauge length, to independently verify thermal uniformity to within ±5 K. The densification experiments are described individually below, and summarized in Table I. In all cases the experiments were periodically interrupted by excursions to room temperature for density measurement, as described below. All thermal cycles were triangular between 400 and 200° C. with ramp rates of 100 K/min.

Example 3a

Specimens A and B

Two shorter specimens were prepared from each of these two failed creep specimens. One half was subjected to isothermal annealing (A1 at 351° C. and B 1 at 400° C.) while the other half was thermally cycled (A2 and B2, 200–400° C.).

Example 3b

Specimen C

This specimen was thermally cycled for comparison with specimens A2 and B2, all of which were originally crept at 400° C. but with different tensile stresses.

Example 3c

Specimen D

This specimen was very long (62.16 mm), allowing for accurate measurement of linear shrinkage for comparison with the volumetric shrinkage (i.e., density) data.

The volume fraction of creep cavities was assessed by density measurement using the Archimedes method in distilled water. Water temperature was measured to within ±0.1 K, and the density of water corrected for temperature dependence using data from the literature. The relative error of the density measurements is estimated to be approximately 0.02%.

Densification Kinetics

Figure 3:
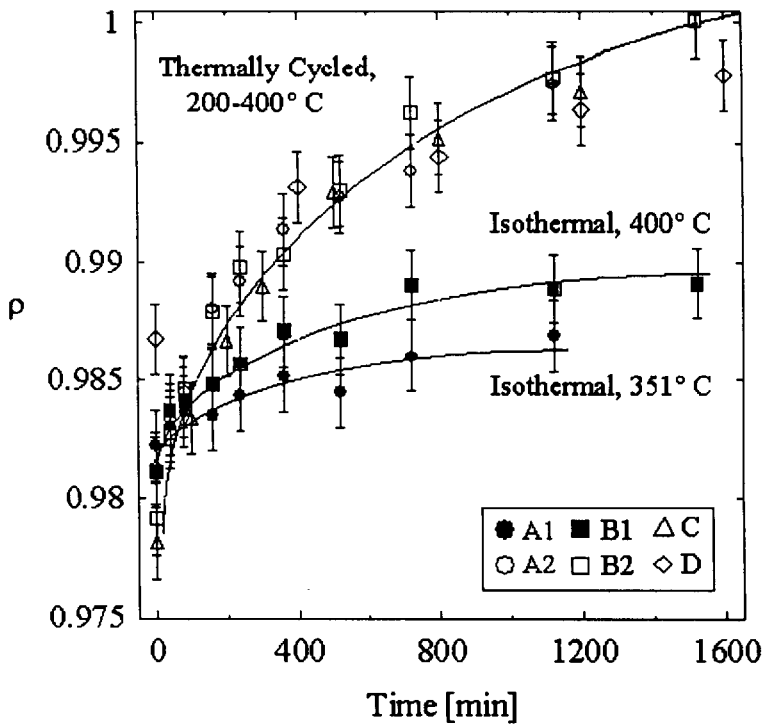
FIG. 3 is a graphic plot of relative density ρ as a function of isothermal or thermal cycling heat treatment time at the temperature shown. Symbols correspond to specimen designations in Table I. The densities and rates shown in FIG. 3 are representative of the results attainable through the present invention, as can be applied to a variety of compositions, materials and/or material systems.

FIG. 3 shows the relative density ρ of specimens A–D as a function of time, subjected to either isothermal or thermal cycling heat treatments. Although the average temperature during cycling was lower than 400° C., the densification of thermally-cycled specimens occurred more rapidly than either isothermally-annealed specimen. The measured density changes can be attributed entirely to volumetric shrinkage, as the mass of each specimen (Table I) was constant within 1 mg over the duration of the treatments. This observation rules out the possibility of density changes due to the accumulation of surface oxide.

Although the cavitated microstructures resulted from different sets of creep conditions (Table I), all of the specimens had similar initial relative densities, ranging between 0.978 and 0.987. In FIG. 3, the densification curves of all four thermally cycled specimens are nearly coincident, and one specimen reached a relative density of unity after 1500 minutes, or 375 thermal cycles. In contrast, both isothermally-treated specimens (351° C. and 400° C.) exhibited only small increases in relative density after similar times.

Figure 4:
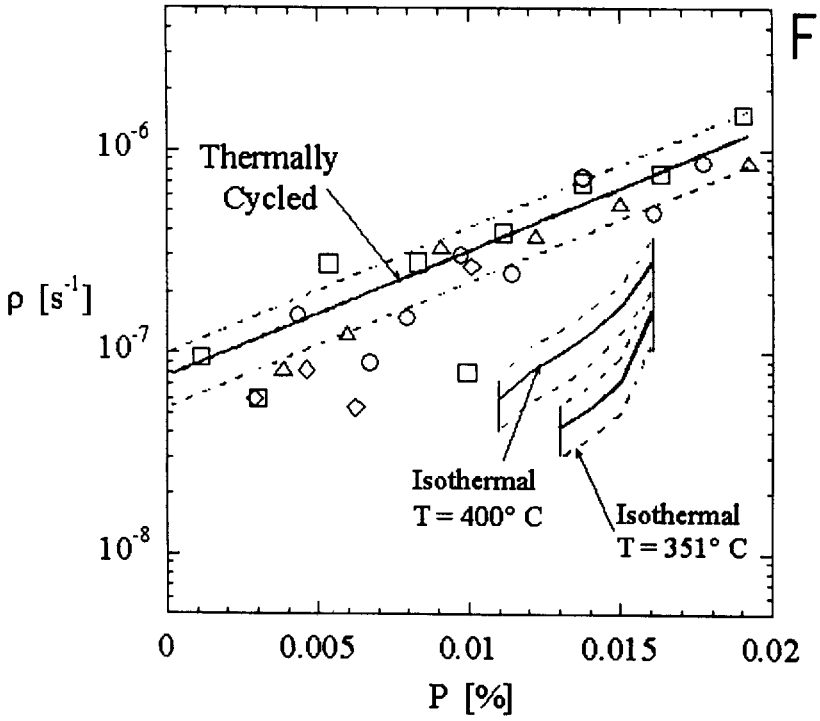
FIG. 4 shows densification rates ρ as a function of porosity P during isothermal or thermal cycling heat treatment of DSC-Al, with ±30% bounds shown in dashed lines. For the thermal cycling experiments, data points (with the same symbols as in FIG. 3) are shown for comparison with the trendline determined from polynomial fitting.

For the discussion to follow, it is useful to determine the experimental densification rates, $\rho = dp/dt$, from the experimental data. This is accomplished by fitting the data of FIG. 3 with smooth polynomial functions, which are then differentiated to determine the densification rates. The results are shown in FIG. 4 plotted against the specimen porosity, $P = 1 - \rho$, with estimated error bars of ±30%. For comparison, the density changes during thermal cycling experiments were also determined by calculating the slope between consecutive experimental data points, as shown by the data points in FIG. 4. These data points and the band of densification rates determined from the polynomial fitting method are in general agreement. As illustrated by FIG. 4, the densification rates for thermally-cycled specimens are notably larger than those for the isothermal specimens, with the enhancement increasing slightly at lower porosity.

Microstructural Observations

Example 4

In addition to the above densification experiments, one previously-crept specimen (Specimen E, see Table I) was prepared for observation by transmission electron microscopy (TEM). Specimens with a thickness of approximately 0.5 mm were sectioned using a diamond saw and ground manually to a thickness of about 20 μm on grit papers. Disks with a diameter of 3 mm were then punched and thinned to perforation using a Gatan Dual Ion Mill operating at a voltage of 5 kV, a current of 1 mA and an angle of 15° on a cold stage sample holder. The specimens were observed in a Phillips 420 TEM operating at 120 kV.

Figure 2:
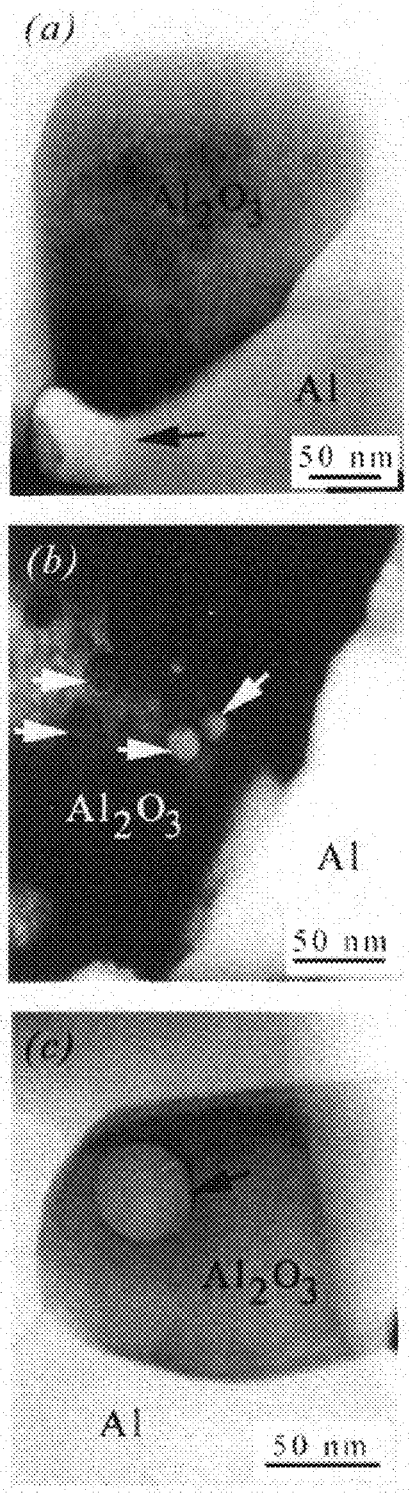
FIG. 2 provides three TEM micrographs showing representative microstructural features of DSC-Al in the post creep condition.

Three TEM micrographs shown in FIG. 2 depict representative microstructural features of DSC-Al in the post-creep condition. As reported in the literature, the $Al_2O_3$ dispersoids are about 0.3 μm in diameter, and generally equiaxed. In addition, many small cavities are observed in the crept gauge-section of DSC-Al. FIG. 2*a* depicts a single cavity ~100 nm in diameter, located at the interface between the Al matrix and $Al_2O_3$ dispersoids; in this example, the cavity is noted to bridge the matrix between neighboring particles, so it lies on at least two $Al/Al_2O_3$ interfaces, FIGS. 2*b* and 2*c* illustrate additional cavities, which, in these projections, lie above or below their associated oxide particles. These micrographs further demonstrate that a single dispersoid may exhibit more than one cavity (FIG. 2*b*), and that some of the cavities exhibit facetted surfaces (FIG. 2*c*). The cavities found in the crept gauge section of DSC-Al were invariably associated with neighboring dispersoid particles, suggesting that all of the observed cavities were located at $Al/Al_2O_3$ interfaces (as for the specific example seen in FIG. 2*a*), and that these cavities were not preparation artifacts. Finally, the observed cavity sizes ranged from ~10 nm to ~180 nm.

Intermittent Creep Experiment

Example 5

The effect of cavity closure on the creep behavior of DSC-Al was investigated by an intermittent isothermal creep experiment. An as-cast tensile creep specimen with gage length of 50.3 mm and gage diameter of 4.67 mm was tested in air in a three-zone furnace at a constant temperature of 400±1° C. After heating to the test temperature in about 15 minutes and soaking for 40 minutes, a tensile stress of 56.2 MPa was applied. The gage displacement was measured by an extensometer and a linear voltage displacement transducer (LVDT) with a resolution of 0.5 μm. At regular strain intervals of about 1%, the load was removed, heating was interrupted, and the specimen cooled to room temperature in about 2 hours. Following density measurement, the specimen was subjected to 100 thermal cycles between 200 and 400° C., in the same fashion as specimens A2, B2, C, and D above. The density of the cycled specimen was measured again, and the above creep procedure repeated.

This intermittent cycle of isothermal creep and thermal-cycling annealing was repeated until the specimen failed.

The geometry of the creep specimen was such that the gauge volume was about one-third of the total specimen volume. Therefore, at each stage of the experiment, the density of the gauge section was calculated assuming that the specimen heads remained at the initial density of the specimen and did not develop cavities during creep. Additionally, although there was some initial casting porosity in the specimen heads, this porosity was assumed non-densifying during thermal cycling.

Figure 6:
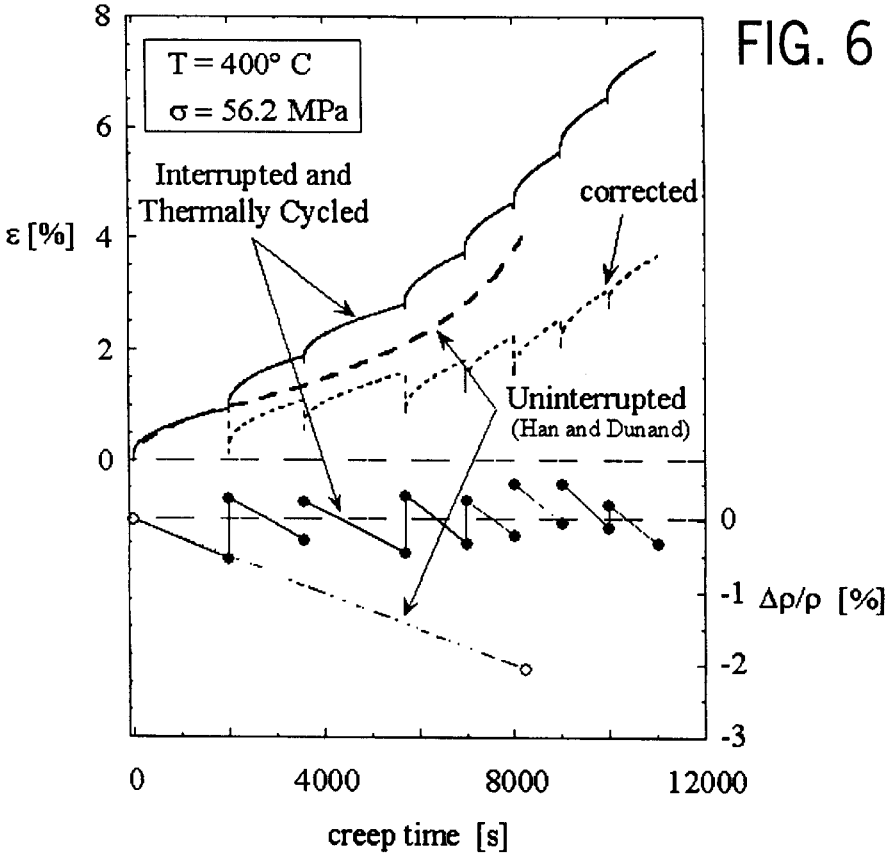
FIG. 6 shows, graphically, creep curves and relative density evolution for specimens which were crept to failure with and without intermittent thermally-cycling without applied stress. Also shown is the creep curve of the intermittently-cycled specimen after correction for gauge shrinkage during the cycling treatment.

FIG. 6 shows the creep curve obtained at 400° C. and 56.2 MPa for the intermittently cycled specimen, compared with an uninterrupted creep test of the same material at the same stress and temperature. The several creep curves obtained during the intermittent test have been concatenated to reconstruct the full creep history. Also shown in FIG. 6 are the relative density histories of the two specimens, which show that uninterrupted creep allows for the accumulation of several percent porosity at fracture, while intermittent cycling maintains the specimen density at a nearly constant level. Indeed, the density of the intermittently cycled specimen was, at several stages of the experiment, higher than the initial value. This result is probably due to the shrinkage of casting porosity present in the as-cast specimen before the creep test. Shrinkage and closure of casting porosity is not limited to the gauge section of the specimen; this is a source of error in the determination of the gauge porosity which may increase over the several successive stages of the experiment.

Figure 5:
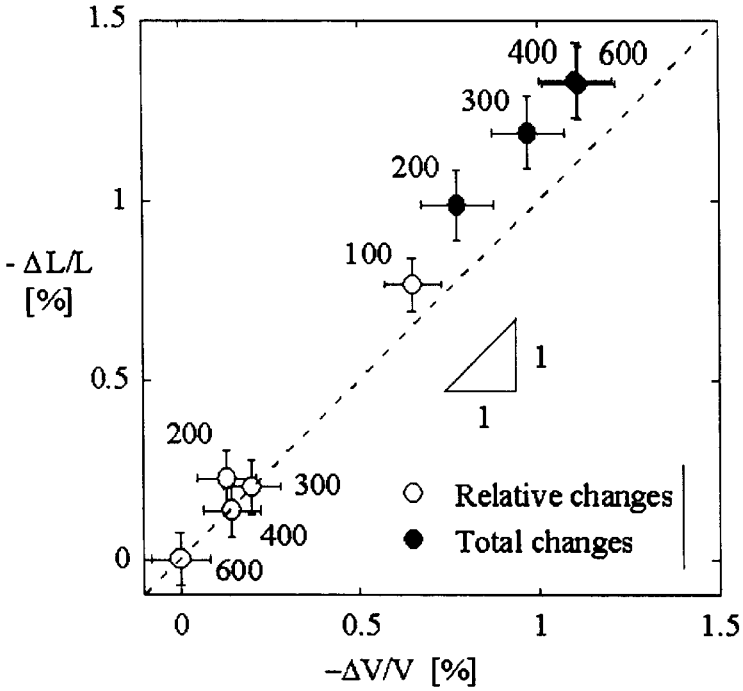
FIG. 5 shows length and volume changes during thermal-cycling densification of Specimen D (Table I). Filled symbols represent total changes relative to the initial length and volume of the specimen, and open symbols represent relative changes between successive stages of thermal cycling. The number of thermal cycles is labeled next to each point.

As demonstrated in FIG. 5, each stage of thermal cycling results in a contraction of the gauge length which has not been accounted for in the creep history of FIG. 6. After each stage of thermal cycling, there is a shrinkage strain in the specimen gauge, given by FIG. 5 as:

$$\epsilon = -\Delta V/V \tag{1}$$

Applying this correction to each stage in the intermittent creep history yields the dotted curve in FIG. 6. This corrected creep history reflects the true specimen length at any given time during the experiment, while the uncorrected curve indicates the total tensile strain accumulated by creep.

The uninterrupted test and the intermittent thermal-cycling experiment both failed at true strains of about 4%, after accounting for the shrinkage accumulated during thermal cycling. However, the cycled specimen was able to sustain a larger amount of total creep strain (about 7.5%), corresponding to a lifetime of 184 min., an increase of about 1/3over the uninterrupted experiment described in the literature.

Densification Shrinkage

Example 6

FIG. 5 shows the relationship between the linear shrinkage ($-\Delta L/L$) along the gauge length (i.e., the direction of the applied stress during creep) and the volumetric shrinkage ($-\Delta V/V$) of specimen D, which was densified by thermal cycling. The volume change was calculated from the density measurements after each stage of thermal cycling. The solid points represent changes with respect to the initial condition of the specimen ($V_0$=1.067 $cm^3$ and $L_0$=62.16 mm), while the open points represent changes between subsequent stages of thermal cycling and density measurement. These two sets of points represent the same data, and therefore are collinear. The slope of the data is unity within experimental error, with an intercept near zero.

The largest volumetric, change observed during any stage of cycling was about 0.7%, corresponding to the first 100 thermal cycles, while subsequent sets of cycles resulted in smaller relative changes, as also shown in FIG. 3. FIG. 5 further shows that for each set of thermal cycles, the relative length change was nearly equal to the relative volume change of the specimen. Finally, when the specimen was fully dense and no additional volume shrinkage was detected, there was no additional length change either, corresponding to the datum point at the origin of FIG. 5. This observation rules out thermal ratchetting as a possible contributor to densification.

Kinetics of Cavity Shrinkage

As discussed in the literature and referring to treatment of "final stage" powder densification, there are three main mechanisms for cavity closure by sintering processes: boundary diffusion, volume diffusion, and creep. The following examples identify a dominant mechanism of densification during the present isothermal experiments. The effects of thermal cycling are then considered through the production of internal thermal mismatch stresses. Thus, the enhanced densities and rates of densification observed experimentally can be 1) rationalized by combining densification theory with micromechanical calculations of thermal stress, and 2) by analogy can be achieved for various other materials through extension of the present invention.

Microstructure and Densification Geometry

Example 7

Previous high-temperature deformation studies of DSC-Al provide strong indirect evidence that creep cavities are located at the matrix/dispersoid interfaces. First, creep-fracture surfaces of DSC-Al were examined by scanning electron microscopy and observed dimpled surfaces, with dispersoids located at the base of the dimples. [D. C. Dunand, B. Q. Han, and A. M. Jansen:*Metall. Mater. Trans.,* 1999, vol. 30A, pp. 829–838.] Second, cast DSC-Al, with 1 mm-sized matrix grains, and extruded, recrystallized DSC-Al, with ~1 $\mu$m grains, exhibit the same rate of cavitation under identical creep conditions. This result indicates that it is the total matrix/dispersoid interfacial area, and not the total grain boundary area, which controls cavity growth. The TEM micrographs in FIG. 2 agree with the above indirect evidence, showing ~10–100 nm cavities located at $Al_2O_3$ dispersoids. The TEM observations further indicate that a single dispersoid may be associated with multiple cavities (FIG. 2*b*), and a single individual cavity may link two neighboring dispersoids (FIG. 2*a*).

Figure 7A:
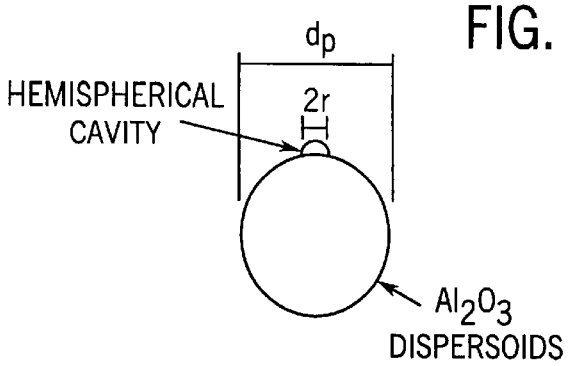
FIG. 7 provides schematic representations of microstructural units; (a) hemispherical cavities decorate spherical dispersoid particles, and (b) cylindrical cavities bridge matrix ligaments to coordinate two dispersoids (see FIG. 2*a*).

The following compares the macroscopic relative density to the size of an average microscopic cavity through a simplified geometry based on the above microstructural observations. Cavities are taken as hemispherical (FIG. 7*a*), with an average of $N_c$ cavities coordinating each dispersoid at the dispersoid/matrix interface. The porosity and relative density of the composite can be related to the average cavity radius, r, through:

$$P \equiv 1 - p = \frac{2}{3} \cdot \pi \cdot N_c \left(\frac{r}{\lambda_p}\right)^3 \tag{2}$$

where $\lambda_p$ is the average center-to-center dispersoid spacing, which can be expressed as a function of the volume fraction and average diameter of dispersoids. The macroscopic densification rate, dr/dt, can then be expressed as a function of the microscopic cavity shrinkage rate -dr/dt:

$$\dot{\rho} \equiv \frac{d\rho}{dt} = -2 \cdot \pi \cdot \frac{N_c}{\lambda_p^3} \cdot r^2 \cdot \frac{dr}{dt} \tag{3a}$$

Changes in the specific assumptions regarding the arrangement of dispersoids, shape of the cavities, etc., do not alter the important result that the densification rate is proportional to the average cavity shrinkage rate. For example, if the cavities are taken to be cylindrical with radius r, bridging the matrix between two dispersoids (FIG. 2*a*) as shown schematically in FIG. 7*b*, then Eq. (3*a*) is replaced by:

$$\dot{\rho} = -2 \cdot \pi \cdot \frac{(\lambda_p - d_p)}{\lambda_p^3} \cdot N_c \cdot r \cdot \frac{dr}{dt} \tag{3b}$$

Densification Mechanisms

Example 8

Densification must proceed by the removal of vacancies from cavities to sinks, or equivalently, by the transport of atoms at external surfaces to cavities. Thus, any process of atomic diffusion or non-conservative dislocation motion is a potential densification mechanism. In the present work, densification is time-dependent (FIG. 3), so processes of boundary or bulk diffusion as well as creep are of interest. There are several models of cavity shrinkage by each of these mechanisms, which predict the cavity shrinkage rate as a function of the cavity radius, material parameters and state variables. [A. S. Helle, K. E. Easterling, and M. F. Ashby: *Acta Metall.,* 1985, vol. 33, pp. 2163–2174; T. Shibutani, T. Kitamura, and R. Ohtani: *Metall. Mater. Trans.,* 1998, vol. 29A, pp. 2533–2542; D. S. Wilkinson and M. F. Ashby: *Acta Metall.,* 1975, vol. 23, pp. 1277–1285; G. C. Kuczynski: *Acta Metall.,* 1956, vol. 4, pp. 58–61.] Since these mechanisms are limited by the kinetics of diffusion, they all incorporate a strong temperature dependence through an Arrhenius parameter:

$$\dot{\rho} \propto \exp\left(-\frac{Q}{R \cdot T}\right) \tag{4}$$

where R is the gas constant, T is the absolute temperature, and Q is an activation energy for diffusion, which is characteristic of the dominant densification mechanism.

In this example, only two isothermal densification temperatures were considered (351 and 400° C.), making experimental determination of Q by estimate. However, densification rates are themselves density dependent, allowing the value of Q to be determined from Eq. (4) at each relative density over which the two data sets coincide. The two sets of experimental isothermal densification data (FIG. 4) coexist over the range $\rho \approx 0.984$–$0.987$, about half of the full measured range $\rho \approx 0.983$–$0.989$. When Q is determined over this range using Eq. (4) with the fitted isothermal densification rates from FIG. 4, values in the range $Q \approx 40$–$65$ kJ/mol are found.

Example 9

This activation energy for densification is significantly below that of volume diffusion in aluminum ($Q_v$=142 kJ/mol), which would be characteristic of bulk-diffusional densification or power-law creep, were either of these the dominant mechanism of densification. Since diffusion of Al in dislocation cores occurs with $Q_d$=84 kJ/mol, even an extremely high dislocation density would not account for the experimentally-measured temperature dependence of densification. The activation energy for grain-boundary diffusion in aluminum ($Q_{gb}$=82 kJ/mol) is also somewhat larger than the experimental value. Furthermore, with matrix grains in the mm-size range, diffusion along grain boundaries can be neglected as a significant contributor to cavity shrinkage. [H. J. Frost and M. F. Ashby: *Deformation-Mechanism Maps: The Plasticity and Creep of Metals and Ceramics*, Pergamon Press, Oxford, 1982.]

Given low experimental activation energies, it is proposed that the isothermal densification of DSC-Al is kinetically limited by diffusion of Al atoms along the interface between matrix and dispersoids. Even though there is no direct experimental evaluation of Q for $Al/Al_2O_3$ interfacial diffusion, this suggestion is supported by data of Hasegawa et al., who performed creep experiments on oxide dispersion-strengthened aluminum with a volume fraction of submicron alumina dispersoids similar to that of DSC-Al (f=0.22) and matrix grains of about ~0.5 $\mu$m diameter. [T. Hasegawa, K. Minami, and T. Miura: in *Creep and Fracture of Engineering Materials and Structures*, B. Wilshire and R. W. Evans, eds., The Institute of Metals, London, 1990, pp. 159–168.] At high stresses (60–300 MPa) there has been identified a power-law creep regime with an activation energy characteristic of volume diffusion in Al ($Q \approx 145$ kJ/mol). At lower stresses (10–100 MPa), there has been observed deformation characteristic of grain- or phase-boundary sliding creep (i.e., stress exponent of 2), but with an activation energy of $Q = 46 \pm 2$ kJ/mol. This value was determined from data at five temperatures over the range 150–550° C. for each of four tensile stresses, and thus has only a small experimental error bar.

Both the creep data shown in the literature ($Q = 46 \pm 2$ kJ/mol) and the present densification data (Q=40–65 kJ/mol) suggest the operation of a diffusional process with an anomalously low activation energy. Similar results have been found for diffusional creep of yttria-dispersion-strengthened magnesium,[B. Q. Han and D. C. Dunand: in *Creep Behavior of Advanced Materials for the 21st Century*, R. S. Mishra, A. K. Mukherjee, and K. L. Murty, eds., TMS, Warrendale, Pa., 1999, pp. 149–158.] and for creep push-out of quartz and nickel fibers from a lead matrix. [J. V. Funn and I. Dutta: *Acta Mater.,* 1999, vol. 47, pp. 149–164.], suggesting that this low activation energy corresponds to diffusion of Al in the dispersoid/matrix interface. Given the position of cavities at $Al_2O_3$ interfaces (FIG. 2), it is reasonable to consider a process in which vacancies are emitted from the cavity into the $Al/Al_2O_3$ interface, followed by interfacial diffusion to a pinned matrix dislocation. Since dispersoid particles are well-known sites of dislocation pinning (dislocations produced during creep or thermal cycling), it is expected that a high dislocation density will be maintained during high-temperature annealing. [A. M. Jansen and D. C. Dunand: *Acta Mater.,* 1997, vol. 45, pp. 4583–4592.] In light of the high dislocation density and the large average distance from cavities to grain boundaries, dislocations are likely to be the dominant sink sites for vacancy annihilation.

Example 10

Assuming that the above mechanism is indeed dominant during the isothermal densification of DSC-Al, the model of Speight and Beere gives the rate of shrinkage or growth of a cavity at a grain boundary:

$$\frac{\partial r}{\partial t} = \frac{4 \cdot \Omega \cdot \varphi \cdot \delta D_{o,b} \cdot \exp\left(-\frac{Q_b}{R \cdot T}\right)}{r^2 \cdot k \cdot T} \tag{5}$$

in which $\Omega$ is the atomic volume of the diffusing species, $\delta D_{o,b}$ and $Q_b$ are the pre-exponential constant and activation energy for boundary diffusion, respectively, k is the Boltzmann's constant, and $\phi$ is a cavity spacing parameter. [M. V. Speight and W. Beere: *Metal Sci.,* 1975, vol. 9, pp. 190–191.] The above cavity growth rate has been formulated for a spherical cavity located on a grain boundary, adapted to the case of an axisymmetric cavity on the dispersoid/matrix interface by replacing the boundary diffision parameters $\delta D_{o,b}$ and $Q_b$ with analogous interfacial diffusion parameters, $\delta D_{o,i}$ and $Q_i$.

Figure 7B:
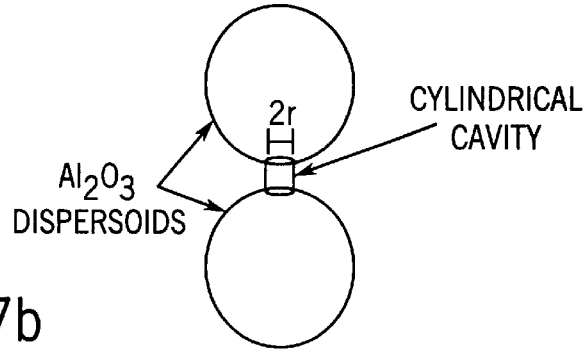

The rate of cavity growth or shrinkage depends on the normal stress at the boundary $\sigma_b$ through the effective pressure $\sigma^*$:

$$\sigma^* = \sigma_b - \frac{n \cdot \gamma}{r} \tag{6}$$

where $\gamma$ is the surface energy of the matrix and negative stresses denote compression. The dimensionless constant n=2 for the hemispherical void (FIG. 7*a*) and n=1 for the cylindrical void (FIG. 7*b*). For the latter case of a cylindrical void, the densification rate (Eq. (5)) is also multiplied by a factor of two, to account for the contribution of two interfaces in the diffusion problem. During isothermal annealing without external pressure, $\sigma_b$=0 and the effective stress reduces to the thermodynamic term, $\sigma^*=-2\gamma/r$ or $-\gamma/r$, for hemispherical and cylindrical cavities, respectively. Although Eq. (5) was originally developed to explain cavity growth during tensile creep with applied stress $\sigma_b$ normal to the boundary, it is equally valid for compressive stresses (negative values of $\sigma_b$), and indeed, has been applied to the case of cavity closure by Riedel. [H. Riedel: *Fracture at High Temperature*, Springer Verlag, Berlin, 1987.]

Example 11

Finally, the macroscopic shape changes observed in the specimen during densification (FIG. 5) are related to the mechanism of densification, as described in the following. Since the cavities in DSC-Al were generated during tensile creep experiments, they are expected to lie on interfaces oriented nearly perpendicular to the applied tensile stress. [H. Riedel: *Fracture at High Temperature*, Springer Verlag, Berlin, 1987.] During densification by the above interface-diffusion mechanism, vacancies are emitted by the cavity directly into the interface, which results in contraction of the material in the prior tensile direction. This model thus predicts no significant contractions in the perpendicular directions, with all of the volume change during densification accommodated by linear shrinkage in the gauge direction. This is indeed the behavior observed during the present thermal-cycling densification experiments (FIG. 5).

Thermal Mismatch Stresses

Example 12

Thermal cycling is anticipated to impact the densification rate through the production of thermal-expansion mismatch stresses between matrix and particles, which affect $\sigma_b$ in Eq. (6). For interfacial diffusion the densification rate depends only upon the stress normal to the interface, which can be readily estimated from micromechanics calculations, as described in the following. [A. C. F. Cocks and M. F. Ashby: *Prog. Mat. Sci.,* 1982, vol. 27, pp. 189–244.]

There are several micromechanical models which predict the internal stress state during thermal excursion of a particle-reinforced composite. [K. K. Chawla: *Ceramic Matrix Composites*, Chapman and Hall, 1993; W. Kreher: *J Mech. Phys. Solids,* 1990, vol. 38, pp. 115–128; T. W. Clyne and P. J. Withers: *An Introduction to Metal Matrix Composites*, Cambridge University Press, Cambridge, 1993; S. J. Park and Y. Y. Earmme: *J Comp. Mater.,* 1999, vol. 33, pp. 1205–1221.] In general, these methods rely upon the Eshelby equivalent inclusion method to assess the average stresses in spherical particles. [J. D. Eshelby: *Proc. Roy. Soc. Lond,* 1957, vol. A241, pp. 376–396.] The "generalized self-consistent model" of Park and Earmme considers thermal dilatation of a spherical reinforcement particle surrounded by a concentric shell of matrix material, embedded in a matrix with thermal and elastic properties of the bulk composite material. [S. J. Park and Y. Y. Earmme: *J Comp. Mater.,* 1999, vol. 33, pp. 1205–1221.] For this case, the principal stress components in the inclusion are all equal and given by:

$$\sigma_i = \frac{3 \cdot K_m \cdot K_i \cdot (\alpha_m - \alpha_i) \cdot (T - T_o)}{f \cdot (K_m - K_i)} \cdot \left[f - \frac{K_i \cdot (K_m - K_c)}{K_e \cdot (K_m - K_i)}\right] \tag{7}$$

where K is the bulk modulus, $\alpha$ the thermal expansion coefficient, $T_o$ the absolute temperature at which there is no thermal mismatch, and where the matrix and inclusion (dispersoid) properties are denoted by subscripts of m and i, respectively. As shown in the literature, the above equation places physical bounds on the particle stresses through the parameter $K_e$, which is the effective bulk modulus of the composite material. [S. J. Park and Y. Y. Earmme: *J Comp. Mater.,* 1999, vol. 33, pp. 1205–1221.] The Hashin-Shtrikman bounds on $K_e$, are:

$$K_e^+ = K_i + (1 - f) \cdot \left[\frac{1}{K_m - K_i} + \frac{3 \cdot f}{3 \cdot K_i + 4 \cdot G_i}\right]^{-1} \tag{8}$$

in the upper-bound, and $$K_e^- = K_m + f \cdot \left[\frac{1}{K_i - K_m} + \frac{3 \cdot (1 - f)}{3 \cdot K_m + 4 \cdot G_m}\right]^{-1} \tag{9}$$

in the lower-bound, where G is the shear modulus of the subscripted phase. [Z. Hashin and S. Shtrikman: *J Mech Phys. Solids,* 1963, vol. 11, pp. 127–140; Z. Hashin: *J Appl. Mech,* 1983, vol. 50, pp. 481–505.] Park and Earmme have shown that these bounds on $K_e$ are appropriately used in Eq. (7) in the limits of f=1 (Eq. (8)) and f=0 (Eq. (9)), and that these bounds match exactly those predicted by Kreher using a variational method. [S. J. Park and Y. Y. Earmme: *J Comp. Mater.,* 1999, vol. 33, pp. 1205–1221; W. Kreher: *J Mech. Phys. Solids,* 1990, vol. 38, pp. 115–128.]

At room temperature, Redsten et al. have shown that the Young's modulus of DSC-Al lies between the bounds established by Eqs. (8,9), somewhat closer to the upper bound. [A. M. Redsten, E. M. Klier, A. M. Brown, and D. C. Dunand: *Mater-Sci. Eng.,* 1995, vol. A201, pp. 88–102.] In the calculations to follow, we assume that this relative positioning of the composite modulus with respect to the Hashin-Shtrikman bounds holds at elevated temperatures, and is given by:

$$K_e = K_e^- + 2/3 \cdot (K_e^+ - K_e^-) \tag{10}$$

where the value 2/3 is chosen according to the experimental Young's modulus data. [A. M. Redsten, E. M. Kier, A. M. Brown, and D. C. Dunand: *Mater-Sci. Eng,* 1995, vol. A201, pp. 88–102.]

Example 13

Figure 8:
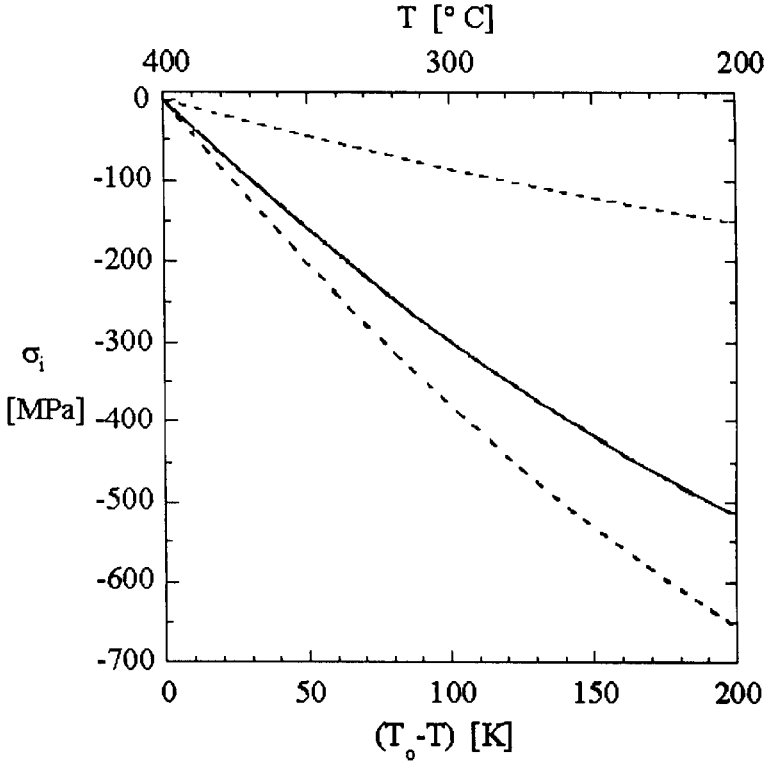
FIG. 8 is a graph plotting principal stresses in alumina-dispersoid particles during thermal cycling from upper temperature $T_o$, as calculated from Eq. (7) using the average bulk modulus from Eq. (10) (solid line). The upper- and lower-bounds (dashed lines) are computed using bulk moduli from Eqs. (8) and (9), respectively.

Use of Eq. (10) in Eq. (7) thus predicts the average principal stress in the $Al_2O_3$ dispersoids for a thermal excursion from a stress-free temperature, $T_o$. Since creep-relaxation of mismatch stresses occurs more rapidly at high temperatures, and since most of the specimens densified in this study were previously crept at 400° C. (Table I), it is reasonable to take the upper-cycling temperature (400° C.) as $T_o$. The use of Eq. (7) in these stress calculations requires that the presence of cavities at the particle/matrix interface be neglected, an implicit assumption which is considered reasonable if the cavity size and volume fraction are small compared to those of the dispersoid particles. Using the temperature-dependent physical properties of pure aluminum and alumina given in Table II, below, the calculated internal particle stresses are shown for the thermal-cycling temperatures (200–400° C.) in FIG. 8. The resulting inclusion stress is compressive and nearly linear in T for the temperatures of interest during the thermal cycling experiments (200–400° C.), and can be reasonably expressed by:

$$\sigma_i=-\kappa_1\cdot(T_o-T)+\kappa_2\cdot(T_o-T)^2 \quad (11)$$

with $\kappa_1$=3.4 MPa/K and $\kappa_2=4\cdot10^{-3}$ Mpa/$K^2$. Due to the large thermal expansion mismatch (~$2.0\times10^{-5}$ $K^{-1}$ on average) the particle stresses during thermal cycling are substantial. For comparison, the upper- and lower-bound stresses calculated using Eq. (7) with Eq. (8) or Eq. (9), respectively, are also shown in FIG. 8.

TABLE II

Materials and microstructural parameters used in the analytical models. Bulk modulus is calculated using K = 2G(1 + v)/3(1 − 2v). Thermal expansion coefficients are fitted over the range 200–400° C.

| Property | Al | $Al_2O_3$ |
|---|---|---|
| Shear modulus, G[Gpa] | $25.4\left(1-0.5\cdot\frac{T-300}{933}\right)$ | $155\cdot\left(1-0.35\cdot\frac{T-300}{2320}\right)$ |
| Poisson's ratio, v | 0.33 | 0.24 |
| Thermal expansion coefficient, $\alpha[10^{-6}K^{-1}]$ | 9.4 + 0.033 · T | 8 |
| Surface energy, $\gamma[J/m^2]$ | 1 | — |
| Burger's vector, b[m] | $2.86\cdot10^{-10}$ | — |

Example 14

In the generalized self-consistent model described above, inter-particle stress interactions are accounted for through the use of bulk composite properties, so the average normal stress on the interface is equal to any principal stress in the inclusion:

$$\sigma_b=\sigma_i \quad (12)$$

From FIG. 8 and Eq. (12), the predicted interfacial stresses vary during thermal cycling, between a stress-free state at the upper temperature and compressive stresses at lower temperatures. Such compressive stresses are expected to increase the cavity shrinkage rate; the magnitude of this increase during our thermal cycles will be assessed in the following section.

Example 15

Before proceeding, it is noted that the calculated internal stresses due to thermal mismatch are large, exceeding the stress required for slip in pure aluminum. [H. J. Frost and M. F. Ashby: *Deformation-Mechanism Maps: The Plasticity and Creep of Metals and Ceramics*, Pergamon Press, Oxford, 1982.] However, because of the fine scale of the dispersoid particles, the dislocation motion is expected to be suppressed in these materials, allowing for local elastic stresses far greater than those required for slip. [A. M. Jansen and D. C. Dunand: in *The Johannes Weertman Symposium*, R. J. Arsenault, et al., eds., TMS, Warrendale, Pa., 1996, pp. 69–80; D. C. Dunand and A. M. Jansen: *Acta Mater.,* 1997, vol. 45, pp. 4569–4581.] During the first several thermal cycles, thermal mismatch is probably accommodated by punching of prismatic dislocation loops. [D. C. Dunand and A. Mortensen: *Acta Metall. Mater.,* 1991, vol. 39, pp. 127–139; R. J. Arsenault and N. Shi: *Mater. Sci. Eng.,* 1986, vol. 81, pp. 175–187.] After several cycles, such dislocations would tend to form tangled networks near the dispersoid particles, yielding a high dislocation density and a work hardened matrix. [D. C. Dunand and A. Mortensen: *Acta Metall. Mater.,* 1991, vol. 39, pp. 127–139.] The increase in matrix yield strength Δσ due to work-hardening can be determined from:

$$\Delta\sigma=1.25\cdot G\cdot b\cdot\rho^{1/2} \quad (13)$$

where G and b are the matrix shear modulus and Burger's vector, respectively, and ρ is the dislocation density developed during thermal cycling. Using the properties of aluminum in Table II and physically-reasonable dislocation densities $\rho=10^{15}$–$10^{16}m^{-2}$, Eq. (13) gives Δσ=245–775 MPa. It is likely that such high dislocation densities would be developed in DSC-Al after only a few thermal cycles. A work hardened matrix with a high yield stress is thus expected during most of the thermal cycles, leading to elastic accommodation of thermal-expansion mismatch. The lack of macroscopic plastic deformation, or strain ratchetting, after many thermal cycles (point at the origin in FIG. 5) also implies that matrix plasticity is suppressed during thermal cycling. Finally, since the thermal cycles were rapid, and the largest stresses are developed at the lower cycling temperatures, it is further reasonable to neglect relaxation of mismatch stresses by diffusional creep.

Densification Enhancement During Thermal Cycling

Example 16

In FIG. 4, the densification rates measured during thermal cycling exceed those measured in the isothermal experiments, even when comparing to isothermal densification at the upper cycling temperature. The true densification enhancement during thermal cycling is best discussed by considering the effective average temperature during cycling, which can be found by averaging the Arrhenius parameter (Eq. (4)) over a full thermal cycle. [D. C. Dunand and C. M. Bedell: *Acta Mater.,* 1996, vol. 44, pp. 1063–1076.] However, given the limited isothermal densification data for DSC-Al, the enhancement factor, δ, is defined as the ratio of the densification rate during cycling to that at the upper cycling temperature. Experimentally, the data in FIG. 4 give values in the range δ≈3–5.5, over the porosity range P=1.1–1.6%. Taking extreme values of ρ within the experimental error bands would somewhat reduce or increase this value.

The densification model of Eq. (5), together with the internal stress calculations summarized in Eqs. (11,12), provide a foundation from which to predict material densification enhancement during thermal cycling. The proportionality between macroscopic densification rate and microscopic cavity shrinkage rate (Eqs. (3)) allow δ to be calculated directly from Eq. (5), giving:

$$\delta = \frac{\frac{1}{\Delta T}\int_{\Delta T}\frac{1}{T}\cdot\exp\left(\frac{-Q_i}{R\cdot T}\right)\cdot\left(\sigma_b(T)-\frac{n\cdot\gamma}{r}\right)\cdot dT}{\frac{1}{T_o}\cdot\exp\left(\frac{-Q_i}{R\cdot T_o}\right)\cdot\left(\frac{n\cdot\gamma}{r}\right)} \tag{14}$$

The integral form of the numerator in the above expression represents the average densification rate during a complete thermal cycle over the temperature range ΔT. With the boundary stress $\sigma_b(T)$ as given by Eqs. (11,12), the above equation can be evaluated at a selected cavity radius r.

Example 17

Figure 9:
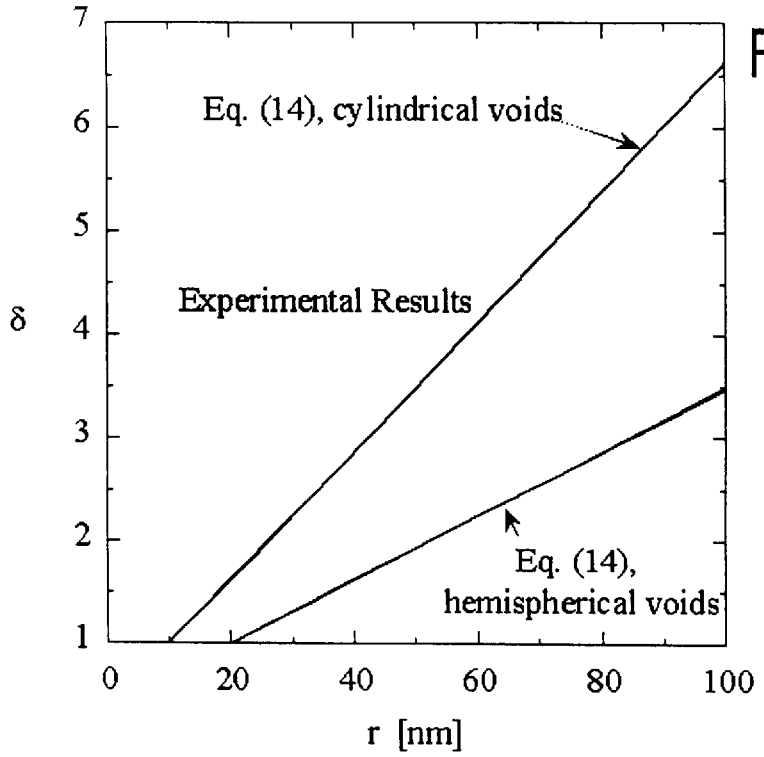
FIG. 9 shows enhancement factor δ, relating the densification rate during thermal cycling to that at the upper cycling temperature, as a function of the cavity radius r. The range of experimental values is denoted by the shaded band, and compared with predictions of Eq. (14).

FIG. 9 shows the predicted values of δ calculated from Eq. (14), using the activation energy Q=46 kJ/mol and γ from Table II, over a physically-reasonable range of cavity radii. The predictions can be compared with the horizontal band in the figure, which indicates the range of values measured experimentally. For larger cavity radii, the model predicts enhancement factors similar to or larger than those found by experiment, particularly if the cylindrical void geometry is used. At smaller cavity sizes, the predicted enhancement diminishes, as the thermodynamic sintering stress (2γ/r) increases relative to the thermal mismatch stresses. However, very small cavities are expected to sinter and disappear rapidly, leaving the largest cavities (e.g., r≧75 nm) to control the kinetics of densification. Therefore, because they limit the densification process, it may be more reasonable to consider the shrinkage of these larger cavities when modeling the densification of a distribution of cavity sizes. Finally, the average spacing between adjacent dispersoids in DSC-Al is about 90 nm; cavities near this size or larger are thus expected to contact two dispersoids, roughly in the cylindrical cavity geometry shown in FIG. 7*b*. The shrinkage of large cylindrical cavities may then limit the densification process.

As would be understood by those skilled in the art, the success of Eq. (14) in predicting enhancements within the experimentally observed range indicates that thermal mismatch stresses are sufficient to fully account for the observed densification enhancement during thermal cycling. Given additional assumptions about the microstructural dimensions and the cavity spacing, the approach described above can also be used with various compositions, materials and/or material systems to predict absolute values of the densification rate during thermal cycling, in addition to the enhancement factor δ. [C. Schuh, B. Q. Han, and D. C. Dunand: in *Symposium to Honor Julia X Weertman*, Y. Chung, et al., eds., TMS, Warrendale, Pa., 1999.]

Rejuvenation of Crept DSC-Al by Thermal Cycling

Example 18

Figure 10:
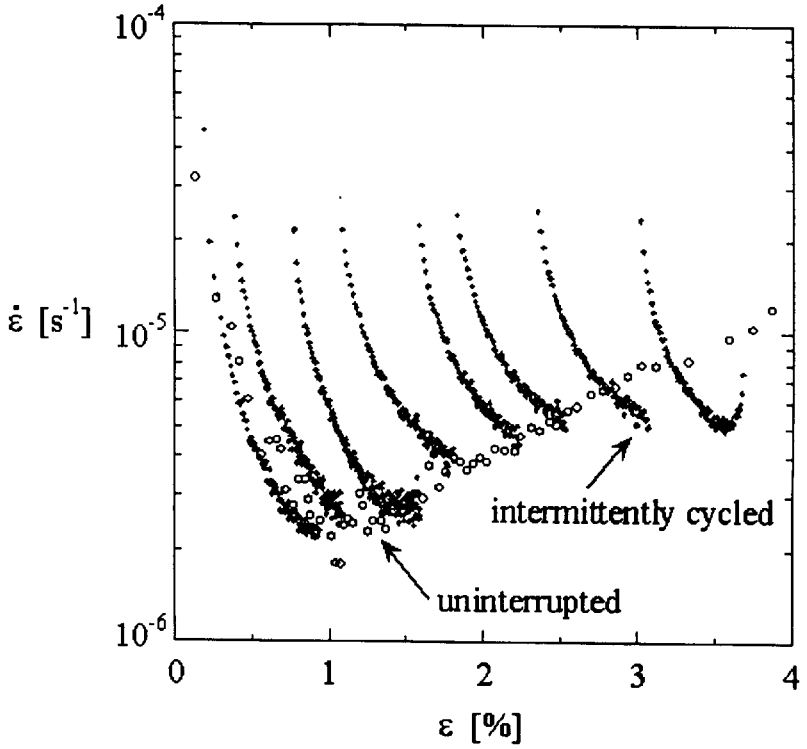
FIG. 10 shows tensile creep rate ϵ as a function of accumulated strain ϵ, for an intermittently cycled specimen, as well as for a DSC-Al specimen subjected to uninterrupted creep.

The larger time-to-failure of the intermittently thermally-cycled creep specimen (FIG. 6) demonstrates that periodic cycling treatments can improve creep performance. FIG. 10 shows the creep rate, $\dot{\epsilon}=d\epsilon/dt$, plotted against the accumulated true strain ε, for both of these specimens. The curve for the uninterrupted specimen is typical of reinforced aluminum materials; following a stage of primary creep a brief minimum creep rate is observed, with a subsequent acceleration to failure (tertiary creep). The increase in creep rate prior to failure is due to the accumulation of cavitation damage, which prohibits a steady-state from being established. [A. M. Jansen and D. C. Dunand: *Acta Mater.,* 1997, vol. 45, pp. 4583–4592.] In contrast to this typical behavior, intermittent thermal cycling treatment prevented the development of extensive cavitation damage (FIG. 6), and therefore prolonged the acceleration of tertiary creep. In the intermittently-cycled specimen, fracture occurred without significant accumulation of cavity volume. This result suggests that creep fracture need not be associated with total cavity volume, but may be controlled by, e.g., total debonded interfacial area or the maximum defect dimension.

The above results on DSC-Al are consistent with many previous reports of creep-life improvement by sintering. [A. Varloteaux, J. J. Blandin, and M. Suery: *Mat. Scl. Technol.,* 1989, vol. 5, pp. 1109–1117; P. W. Davies, J. P. Dennison, and H .E. Evans: *J Inst. Met.,* 1967, vol. 95, pp. 231–234.] However, as shown in FIGS. 3 and 4, isothermal densification is prohibitively slow for this kind of rejuvenation treatment in DSC-Al. The more rapid thermal-cycling densification procedure may thus offer a less-costly alternative to hot isostatic pressing for this purpose.

As discussed more thoroughly above, shrinkage of creep cavities by thermal treatment was examined in DSC-Al, a dispersion strengthened aluminum containing approximately 23% submicron alumina dispersoids, a material illustrative of those which can be treated using the present invention. Isothermal annealing at either 351 or 400° C. resulted in only small density changes, while a thermal-cycling treatment with four-minute thermal cycles between 200 and 400° C. (without applied stress) produced more rapid densification, allowing for full recovery of pre-creep density. Densification rates during thermal cycling were higher by about a factor of 3–5.5 than those observed during isothermal densification at the maximum cycling temperature.

Based on the activation energy of the isothermal densification process, the dominant mechanism of densification is thought to be interfacial diffusion. The diffusive flux is enhanced by compressive stresses on the interface, which evolve during thermal cycling due to thermal expansion mismatch. Using an existing micromechanical model to determine the internal stress state, this mechanism can account for the observed densification enhancement during thermal cycling.

Since the closure of small amounts of closed porosity is typically the most time-consuming stage of sintering processes, accelerated densification by thermal cycling has practical applications. For example, intermittently thermal cycling DSC-Al without external load enhances the creep life by about 35% at 400° C. and 56.2 MPa. By suppressing the formation and/or growth of creep cavities, the onset and acceleration of tertiary creep are delayed.

While the principals of this invention have been described in connection with specific embodiments, it should be understood clearly that these descriptions, along with the chosen tables, figures and data therein, are made only by way of example and are not intended to limit the scope of this invention, in any manner. Various other compositions, materials and/or material systems can be treated as set forth herein, such methods and the parameters thereof as can be modified as taught herein and according to a particular material, composition or system. Other advantages and features of this invention will become apparent from the following claims, with the scope thereof determined by the reasonable equivalents, as understood by those skilled in the art.

What is claimed is:

1. A method of reducing internal material porosity, said method comprising:

providing an internally porous material; and annealing said material over a temperature range providing activation energy sufficient to induce mass transport within said material, said temperature changing over said range during said annealing, whereby said porosity is reduced substantially without phase transformation of said material.

2. A method of claim 1 wherein said material is a polycrystalline single-phase material with anisotropic thermal expansion.

3. The method of claim 1 wherein said material is a multi-phase material.

4. The method of claim 3 wherein said material comprises phases selected from the group consisting of metals, ceramics and combinations thereof.

5. The method of claim 4 wherein said multi-phase material is a metal and metal oxide composite.

6. The method of claim 1 wherein said annealing includes non-cyclic temperature change over said range.

7. The method of claim 1 wherein said annealing includes cyclic temperature change over said range.

8. The method of claim 1 wherein said annealing is repeated for a time sufficient to densify said material.

9. A method of shrinking creep cavities, said method comprising:

providing a multi-phase material composition, said composition cavitated under service conditions;

annealing said composition within a temperature range, said range including temperatures inducing internal stress between phases of said composition; and modifying said temperature within said range during said annealing.

10. The method of claim 9 wherein said material comprises phases selected from the group consisting of metals, ceramics and combinations thereof.

11. The method of claim 10 wherein said multi-phase material is a metal and metal oxide composite.

12. The method of claim 10 wherein said material is a two-phase metal alloy.

13. The method of claim 9 wherein said annealing is repeated for a time sufficient to shrink said cavities.

14. A method of using thermal treatment to enhance the rate of densification of a porous material, said method comprising:

providing an internally porous material;

annealing said material over a temperature range, said range of temperature inducing stresses internal to said material, said temperature changing over said range during annealing; and densifying said material.

15. The method of claim 14 wherein said annealing includes non-cyclic temperature change over said range.

16. The method of claim 14 wherein said annealing includes at least one cyclic temperature change over said range.

17. A method of using thermally-induced internal stress to densify a multi-phase material, said method comprising:

providing a multi-phase material having internal cavities;

annealing said material over a temperature range, said range sufficient to induce internal stress between said phases;

renewing said induced stress for a time sufficient to densify said material.

18. The method of claim 17 wherein said material comprises phases selected from the group consisting of metals, ceramics and combinations thereof.

19. The method of claim 17 wherein internal stresses are induced by non-cyclic temperature changes during said annealing.

20. The method of claim 17 wherein said internal stresses are induced by cyclic temperature changes during said annealing.

* * * * *